US005389019A

United States Patent [19]

Tsujii

[11] Patent Number: 5,389,019

[45] Date of Patent: Feb. 14, 1995

[54] TILT MECHANISM FOR OUTBOARD DRIVE UNIT

[75] Inventor: Eiichiro Tsujii, Hamamatsu, Japan

[73] Assignee: Sanshin Kogyo Kabushiki Kaisha, Hamamatsu, Japan

[21] Appl. No.: 91,607

[22] Filed: Jul. 13, 1993

[30] Foreign Application Priority Data

Jul. 16, 1992 [JP] Japan ..... 4-212246
Aug. 26, 1992 [JP] Japan ..... 4-250824

[51] Int. Cl.[6] ..... B63H 5/12
[52] U.S. Cl. ..... 440/61; 440/900
[58] Field of Search ..... 440/61, 56, 65, 900; 267/64–75; 188/311–314

[56] References Cited

U.S. PATENT DOCUMENTS 4,784,625 11/1988 Nakahama ..... 440/56

FOREIGN PATENT DOCUMENTS 59-100094 6/1984 Japan .
60-116592 6/1985 Japan .

*Primary Examiner*—Edwin L. Swinehart
*Attorney, Agent, or Firm*—Knobbe, Martens, Olson & Bear

[57] ABSTRACT

Three embodiments of hydraulic assemblies for controlling the position of an outboard drive mounted on the transom of a watercraft and for permitting the outboard drive to pop up when an underwater obstacle is struck and to return to its normal position once the underwater obstacle is cleared. In one embodiment, a hydraulic circuit is provided that permits the return to any of a plurality of trim adjusted positions without the necessity of employing a floating piston. In all embodiments, there is also provided a control valve assembly for manually opening the circuitry between the chambers of the hydraulic assembly for manual tilt and trim movement. This control is accessible from either side of the unit.

13 Claims, 10 Drawing Sheets

TILT MECHANISM FOR OUTBOARD DRIVE UNIT

BACKGROUND OF THE INVENTION

This invention relates to a tilt mechanism for an outboard drive unit and more particularly to an improved hydraulic assembly for controlling the position of an outboard drive and an improved control valve arrangement therefore.

It is well known in marine outboard drives, be they either outboard motors or the outboard drive portion of an inboard/outboard drive, to mount the outboard drive for movement relative to the hull of the associated watercraft so that if an underwater obstacle is struck, the outboard drive may pop up to clear the watercraft obstacle without damage. Once the obstacle is cleared, the outboard drive is moveable back to its normal driving condition. The operation is controlled by a hydraulic unit which should also have sufficient resistant to movement so as to hold the outboard drive against popping up when operated in a reverse drive mode.

A wide variety of devices have been proposed for this purpose. However, it is well known to adjust the trim position of an outboard drive to suit various running conditions. For example, when operating in shallow water, the outboard drive may be trimmed up so as to not protrude too deeply into the water. However, when the trim is changed then the hydraulic unit cannot normally accommodate return to a variety of trim adjusted positions once an underwater obstacle is struck and cleared.

It has been proposed to employ a floating piston in the hydraulic unit which acts as a memory so that when an underwater obstacle is struck, the outboard drive may pop up and then return to the trim adjusted position as set by the position of the floating piston. These devices are quite effective. However, the use of the floating piston in the cylinder assembly increases its length and its complexity and thus has some disadvantages.

It is, therefore, a principal object to this invention to provide an improved hydraulic assembly for controlling the position of an outboard drive which will permit the outboard drive to pop up when an underwater obstacle is struck and will permit the outboard drive to return to any trim adjusted position once the underwater obstacle is cleared and without necessitating the use of a floating piston.

It is a further object to this invention to provide an improved and simplified hydraulic control circuitry for such a unit.

When a hydraulic control assembly of the type previously described is employed in conjunction with a marine outboard drive, although the operation of the outboard drive during normal operation can be as desired, the hydraulic unit gives considerable resistance to an operator tilting the outboard drive to a tilted up out-of-the water position. Therefore, it has been the normal practice to provide some form of bypass control valve that permits the shock absorbing valves of the hydraulic unit to be bypassed so that an operator can easily raise the outboard drive without fluid resistance. Normally these control valves are operated by a lever that is positioned on one side or the other of the outboard drive. However, with certain watercraft and certain applications, the control lever is not positioned on the side of the outboard drive that is the most accessible. Thus, certain difficulties occur.

It is, therefore, a still further object to this invention to provide an improved control valve assembly for permitting manual operation of the outboard drive and which is accessible from either side of the outboard drive.

SUMMARY OF THE INVENTION

The invention is adapted to be embodied in a hydraulic assembly for controlling the position of an outboard drive mounted to the transom of a watercraft for movement between a normal drive position and a popped up position when an underwater obstacle is struck and to return to the normal drive position when the underwater obstacle is cleared. The assembly comprises a cylinder that is adapted to be connected to one of the outboard drive and the watercraft. A piston has a piston rod that is connected to the other of the outboard drive and the watercraft. The piston is slideably received in the cylinder and divides the cylinder into two chambers with the piston rod extending through one of the chambers.

In accordance with a first feature of the invention, an accumulator chamber is provided that contains fluid and gas under pressure to accommodate changes in the volume caused by the passage of the piston rod through the one chamber upon relative movement between the outboard drive and the watercraft. First conduit means containing first check valves means permit fluid flow from the one cylinder chamber to the accumulator chamber only. Second conduit means containing second check valve means permit flow the other of the cylinder chambers to the accumulator chamber only. A pressure relief valve permits flow only from one of the cylinder chambers only to the accumulator chamber when the pressure difference is greater than a predetermined amount. A third check valve permits flow only from the accumulator chamber to the other of the cylinder chambers.

In accordance with another feature of the invention, circuitry containing check and relief valves interconnect the two chambers of the cylinder with each for controlling the movement of the outboard drive relative to the watercraft. A bypass valve arrangement is provided for selectively permitting flow between the cylinder chambers without restriction for manual tilting up of the outboard drive. The bypass valve arrangement is operated by a control mechanism that is accessible from either side of the cylinder assembly.

BRIEF DESCRIPTION OF THE DRAWINGS

FIG. 3 shows how the arrangement maintains the unit in its fully trimmed down position in its forward drive position.

FIG. 4 shows how the mechanism avoids popping up from the fully trimmed down condition when operating in a reverse mode.

FIG. 5 shows how the unit is capable of popping up to clear an underwater obstacle when in its fully trimmed down condition.

FIG. 6 shows how the unit returns to its fully trimmed down condition once the underwater obstacle is cleared.

FIG. 7 shows how the unit can be trimmed up manually.

FIG. 8 shows how the unit is maintained in the trimmed up adjusted position.

FIG. 9 shows how the mechanism can be manually trimmed down.

DETAILED DESCRIPTION OF THE PREFERRED EMBODIMENTS OF THE INVENTION

Figure 1:
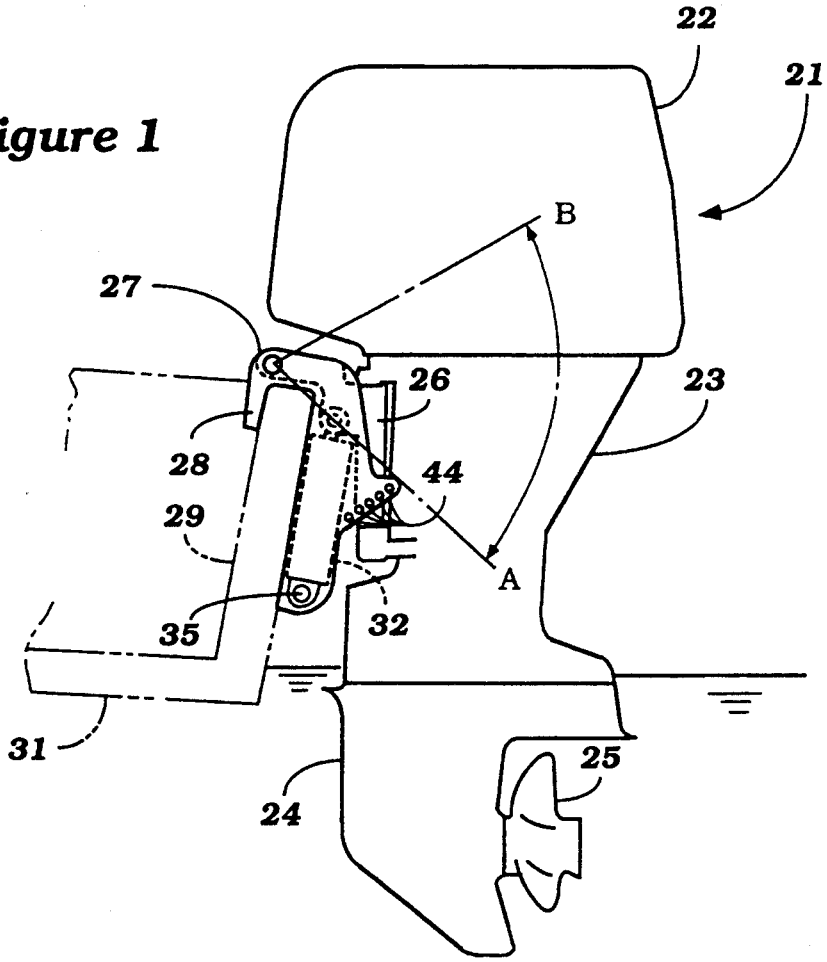
FIG. 1 is a side elevational view a marine outboard drive having a hydraulic tilt and trim mechanism constructed in accordance with a first embodiment of the invention.
Figure 2:
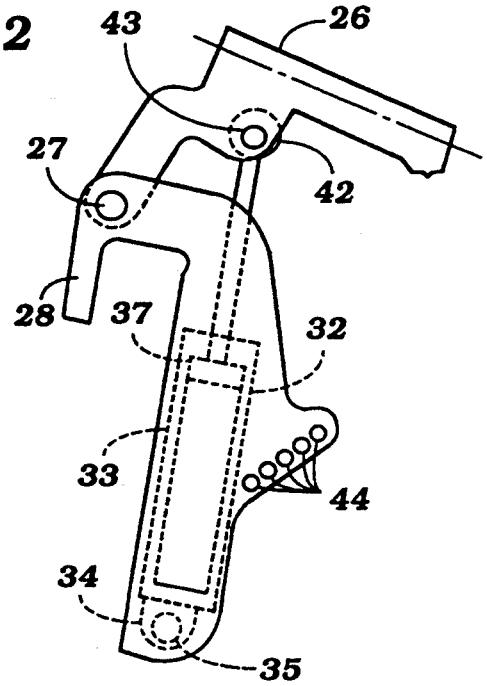
FIG. 2 is an enlarged side elevational view showing the tilt and trim mechanism of the outboard drive alone and in the fully tilted up condition.

Referring now in detail to the drawings and initially to FIGS. 1 and 2, these figures, although particular to the embodiment of FIGS. 1 through 9, show how the hydraulic arrangement of all of the embodiments may be employed in conjunction with an outboard drive. In the illustrated embodiment, the application is employed in conjunction with an outboard motor, indicated generally by the reference numeral 21. It is to be understood, however, that the invention may be employed in conjunction with other types of outboard drives than outboard motors, for example the outboard drive portion of an inboard/outboard drive.

Except for the trim and tilt control mechanism, the outboard motor 21 may be considered to be conventional and for that reason the details of its construction are not shown except for the general outline thereof. The outboard motor 21 is comprised of a power head 22 containing a powering internal combustion engine of any known type (not shown) and surrounded by a protective cowling. This engine drives a drive shaft (not shown) that is rotatably journalled in a drive shaft housing 23 that depends from the power head 22 and which terminates in a lower unit 24. A conventional forward, neutral, reverse transmission (not shown) in the lower unit 24 transmits drive from the drive shaft to a propeller 25 in a well known manner.

A steering shaft (not shown) is affixed to the drive shaft housing 23 and is journalled for steering movement about a generally vertically extending steering axis in a swivel bracket 26. The swivel bracket 26 is, in turn, pivotally connected by means of a pivot pin 27 to a clamping bracket 28 that is affixed in any known manner to a transom 29 of a watercraft, shown partially in phantom and indicated by the reference numeral 31.

A hydraulic assembly, indicated generally by the reference numeral 32 is interposed between the outboard motor 21 and the hull 31 for controlling the movement of the outboard motor 21 about the pivot pin 27 from a fully trimmed down condition "A" to a fully tilted up condition "B", which tilted up condition is shown in FIG. 2. The hydraulic assembly 32 may be best understood by reference to FIGS. 3 through 9 wherein it is shown schematically.

This assembly includes a cylinder assembly 33 that has a trunnion 34 so as to accommodate a pivotal connection by means of a pivot pin 35 to the clamping bracket 28. The cylinder assembly 33 is provided with a cylinder bore 36 in which a piston 37 is supported so as to divide the cylinder bore 36 into an upper, piston rod chamber 38 and a lower chamber 39. A piston rod 41 is affixed to the piston 39 and extends through the piston rod chamber 38 and terminates externally thereof in a trunnion portion 42. A pivot pin 43 provides a pivotal connection between the piston rod 41 and the swivel bracket 26.

It should be noted that the clamping bracket 28 is provided with a series of apertures 44 that are adapted to receive a trim pin (not shown) that will be engaged by the swivel bracket 26 so as to maintain the trim down adjusted position of the outboard motor 21. By this method it is possible, as is well known in this art, to vary the trim adjusted drive position of the outboard motor 21 to suit a variety of circumstances.

Referring now again primarily to FIGS. 3 through 9, as is well known the displacement of the piston rod 41 in the piston rod chamber 38 of the cylinder will give rise to differences in the amount of fluid displaced from or to the chambers 38 and 39 during relative movement. To accommodate these volumn changes, there is provided an accumulator chamber, indicated generally by the reference numeral 45 which may be positioned as part of the cylinder assembly 32 as will become apparent by reference to the embodiments of FIGS. 10 through 14 and 15. This chamber 45 contains a floating piston 46 that contains a fluid chamber 47 beneath the piston 46. A pressurized inert gas such as nitrogen, fills a chamber 48 above the piston 46 and permits the amount of fluid in the chamber 47 to vary to accommodate movement, as will be described.

A first conduit, identified by the reference numeral 49 contains a check valve 51 and connects the piston rod chamber 38 of the cylinder 33 with the accumulator chamber 45. A second conduit 52 containing a check valve 53 communicates the chamber 39 of the cylinder 33 also with the accumulator chamber 45. In this embodiment, the conduits 49 and 52 merge to a common conduit portion 54 that interconnects the conduits 49 and 52 between the check valves 51 and 53 with the accumulator chamber 45. It will be noted that the check valves 51 and 53 act in opposition to each other. Alternatively to this construction, it is possible to provide a separate first conduit 49′ in which the check valve 51′ is positioned which will go to the accumulator chamber 45 directly from the piston rod chamber 38 without any common portion with the second conduit 52.

A pressure operated relief valve 55 is provided in the conduit section 54 and permits flow from the piston rod chamber 38 to the accumulator chamber 45 when a predetermined force is generated due to the striking of an underwater obstacle. This operation will be described later.

In addition, a third check valve 56 is provided in a conduit portion 57 which connects the accumulator chamber 45 with the piston rod chamber 38, in this instance, in part through the conduit 49. In the alternative construction previously described including the first conduit section 49', the check valve 56 will be retained as will a connection between the conduit 57 directly with the piston rod chamber 38.

The system is completed by a manual operator 58 which may be mounted as described in conjunction with the embodiments of FIGS. 10 through 14 and 15 and which permits manual opening of the check valve 53 through an operator portion 59 and manual opening of the relief valve 55 through an operator portion 61. In this embodiment of the invention, the manual operator 58 is operated so that it can actuate first the operator 59 to open the check valve 53 (see FIGS. 7 and 8) and upon subsequent motion to hold the check valve 53 open and also open the relief valve 55 as shown in FIG. 9.

It should be further noted that there is provided a flow restricting orifice 62 in the conduit 54 between the relief valve 55 and the accumulator chamber 45.

Figure 3:
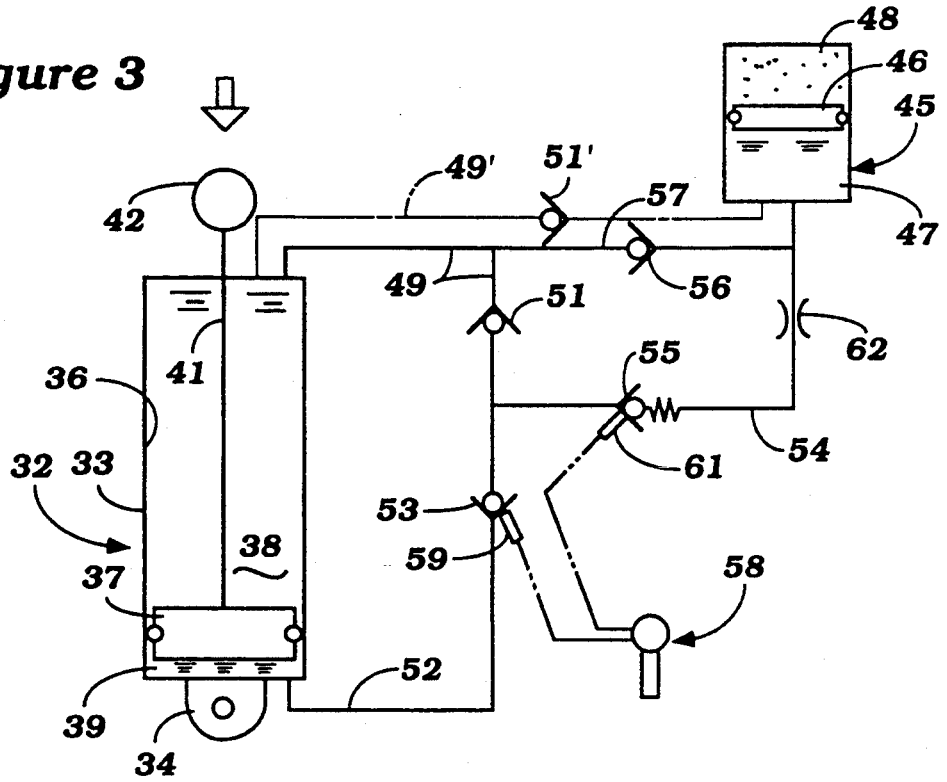
FIGS. 3 through 9 are schematic views showing the hydraulic circuitry associated with the tilt and trim mechanism in various conditions of operation.
Figure 4:
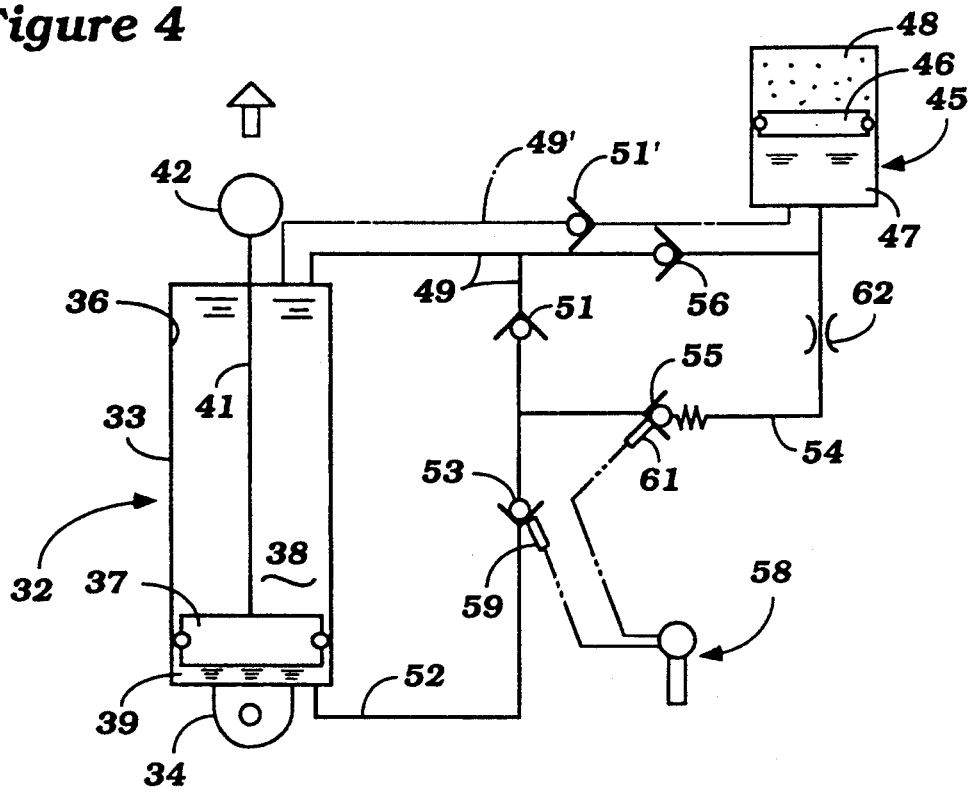

The operational modes of this embodiment will now be described with FIGS. 3 and 4 showing the normal operation from a fully trimmed down condition. In this condition, the operator 58 is positioned so that the check valve 53 and relief valve 55 will operate normally. FIG. 3 shows the operation when operating under a forward drive thrust. When this occurs, the piston 37 will tend to be forced downwardly to compress the fluid in the chamber 39. This pressure will be transmitted through the conduit 52 to the check valve 53 and relief valve 55 in the chamber 54. The relief valve 55 is set so that it will open at a relatively high pressure and, accordingly, under the condition shown in FIG. 3, the system will be locked hydraulically and the driving thrust will be controlled. The aforenoted trim pin in the clamping bracket appetures 44 will also limit the compression of the fluid in the chamber 39.

If the transmission is shifted into a reverse drive mode, then an upward force will be exerted on the piston 37 by the piston rod 41 as shown in FIG. 4. This will compress the fluid in the chamber 38 and increase the pressure in the conduit 49. Again, however, the relief valve 55 will not open under this normal reverse drive pressure and hence the system will be hydraulically held so that the outboard motor 21 cannot pop up.

Figure 5:
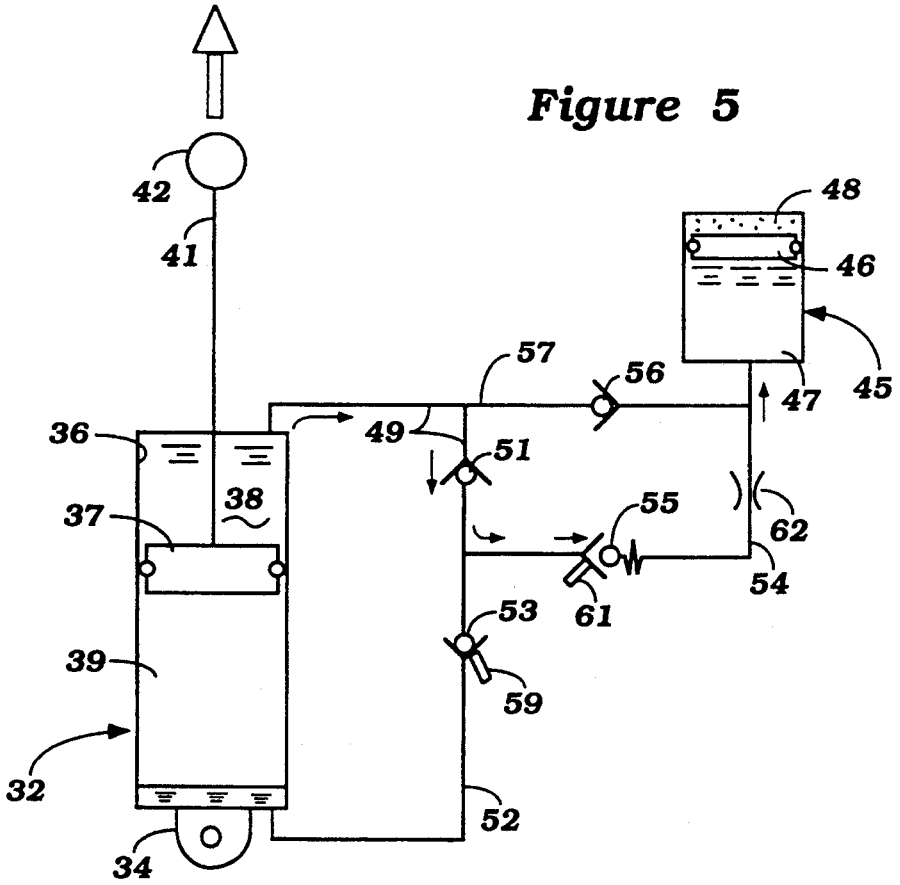
Figure 6:
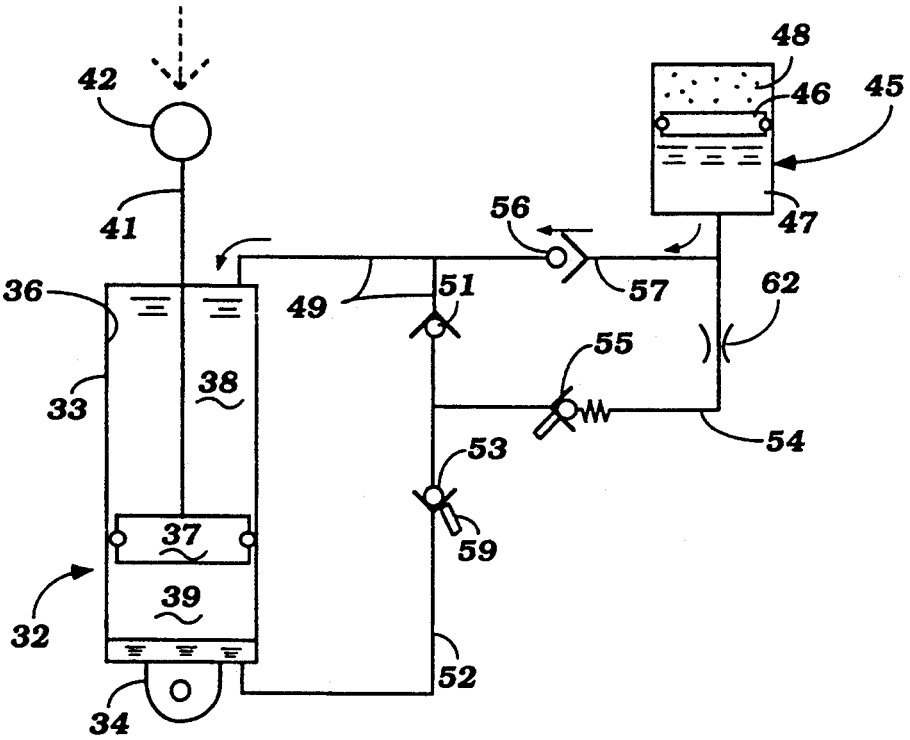

FIGS. 5 and 6 show, respectively, the pop up and return operation from the fully trimmed down drive condition when an underwater obstacle is struck with FIG. 5 showing the pop-up mode and FIG. 6 showing the return mode.

When the underwater obstacle is struck, a force will be exerted on the piston 37 by the piston rod 41 to tend to compress the fluid in the chamber 38. If sufficient force is encountered so as to overcome the action of the relief valve 55, the relief valve 55 will open and fluid can be driven out of the chamber 38 through the first conduit 49 and conduit section 54 so as to force fluid into the accumulator chamber 45 and specifically the chamber portion 47. This causes the piston 46 to move upwardly and compress the compressed gas 48 as shown in FIG. 5. During this movement, the piston 37 will move away from the fluid in the lower chamber 39 and the fluid will cavitate to some extent when this occurs so as to accommodate the popping up action.

Once the underwater obstacle is cleared, the force caused by the weight of the outboard motor 21 will act on the piston rod 41 and cause the piston 37 to lower. When this occurs, the check valve 56 will open and permit flow through the conduit 57 to the first conduit 49 and back into the chamber 37 until the piston 37 reaches its trim adjusted position.

Figure 7:
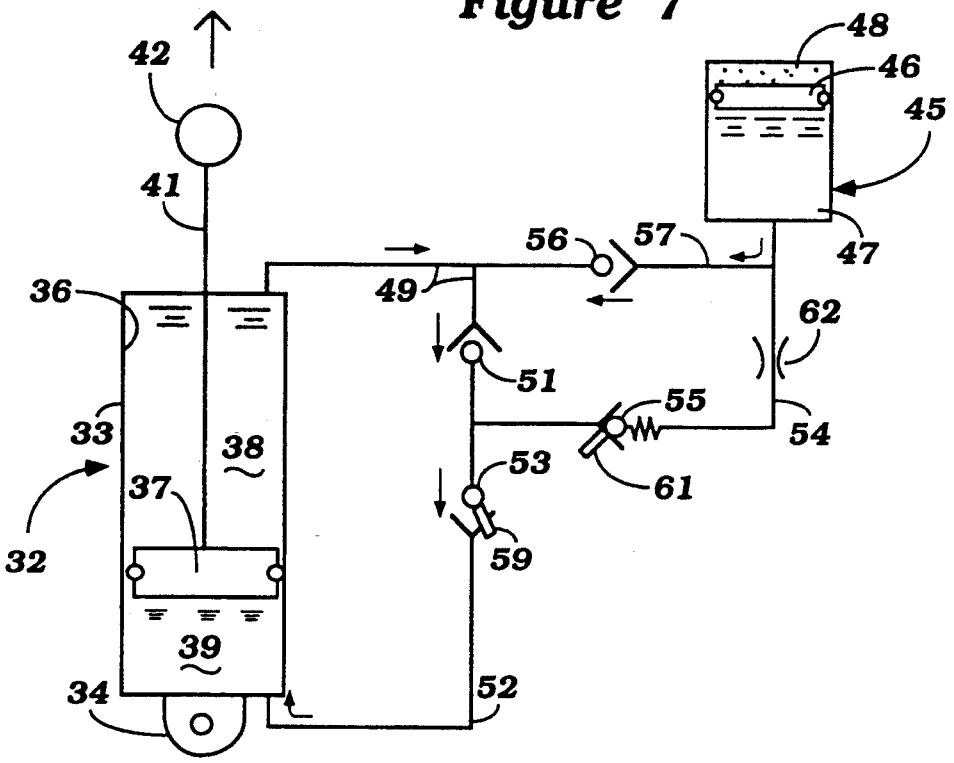
Figure 8:
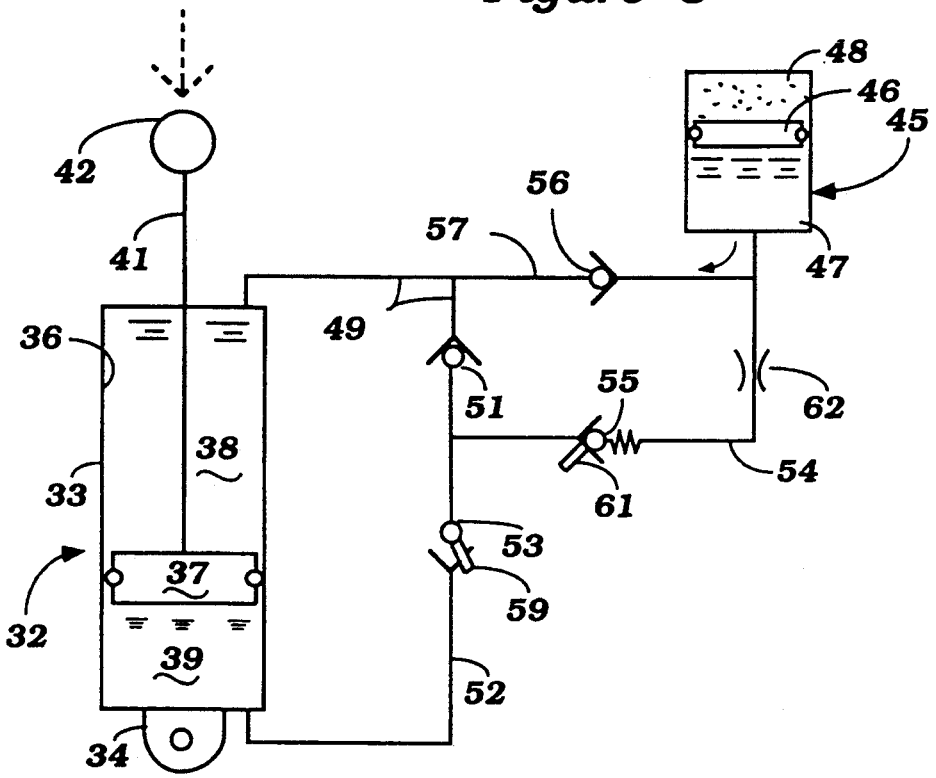
Figure 9:
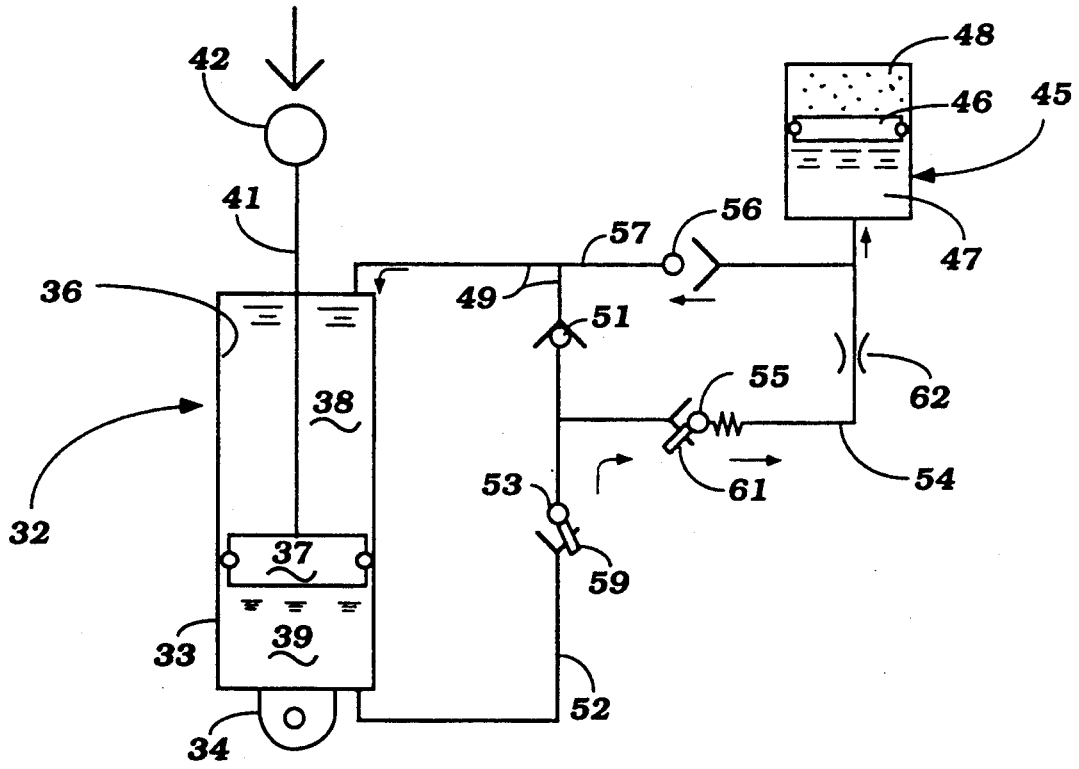

Referring now to FIGS. 7 and 8, these figures show how the outboard motor 21 may be manually trimmed up or tilted up and how the system will hydraulically hold the outboard motor 21 in its new trim adjusted position or in its tilted up position. To accomplish this, the operator control 58 is operated so as to place it in its first position wherein the check valve 53 is manually opened by the operator 59 as shown in these figures. When this is done, the user may either elevate the outboard motor 21 or operate it in a reverse drive mode so as to cause an upward force to be exerted on the piston 37 through the piston rod 41.

When this occurs, fluid will be forced from the chamber 38 through the first conduit 49 so as to open the check valve 51. Flow may then flow as shown in the direction of the arrows in FIG. 7 past the open check valve 53 through the conduit 52 to the lower piston chamber 39. Since the piston rod 41 displaces fluid from the chamber 38 and there is no piston rod in the chamber 39, make-up fluid must be provided to the lower chamber 39 because the amount of fluid displaced from the chamber 38 is less than that required by the chamber 39. This make-up fluid is provided from the accumulator chamber 45 through opening of the check valve 56 as shown in FIG. 7.

Once the desired position is reached, then the operator can cease applying upward force to the outboard motor 21 and its weight will again then act on the piston rod 41 and piston 37. However, no fluid can escape from the chamber 39 until the pressure is greater than that required to open the relief valve 55 and hence, the outboard motor 21 will be held in its trimmed up or tilted up adjusted position. If trimmed up, popping up action can occur in the same manner as described in conjunction with FIGS. 3 and 4 and once the underwater obstacle is cleared, the outboard motor 21 will return to its trimmed up adjusted position.

FIG. 9 shows how the outboard motor 21 may be returned to a lowered positioned from either the trimmed up adjusted position or the tilted up position. To accomplish this, the operator control 58 is moved to its second position wherein both the check valve 53 is held open by the operator 59 and the relief valve 55 is then opened by the operator 61. Then any downward force on the piston 37 transmitted through the piston rod 41 will cause fluid to be expelled from the chamber 39 through the conduit 52 past through open check valve 53 and open relief valve 55 to the accumulator chamber 45 as shown by the arrows in FIG. 9. Fluid is returned to the chamber 38 from the accumulator chamber 45 through opening of the check valve 59 with the flow being accommodated through a portion of the conduit 49 and conduit 57 as also shown in the arrow. Hence, the outboard motor 21 may be easily manually tilted or trimmed up or down while the popping up operation is retained. All of this is accomplished without the necessity of employing a floating piston.

FIGS. 10 through 14 show another embodiment of the invention and specifically an actuator which may be employed in conjunction with the operators for the valve actuators 59 and 61 of the embodiment of FIGS. 1 through 9. The hydraulic circuitry in this embodiment is different in this embodiment, as will be described, and employs a floating piston for retaining the unit in its trim adjusted position. The connection of the hydraulic assembly, indicated generally by the reference numeral 101 in this embodiment to the swivel bracket 26 and clamping bracket is the same as in the previously described embodiment and, for that reason, these components have been identified by the same reference numerals and will not be described again, except in so far as is necessary to understand the construction and operation of this embodiment.

Referring now specifically to this embodiment, in addition to the piston 37, there is provided in the chamber 39 a floating piston 102 which acts as a memory piston, in the manner to be described. A pressure responsive valve 103 permits flow from the area beneath the floating piston 102 to the area between the floating piston 102 and the piston 37 but precludes flow in the opposite direction for a reason which will be described.

In addition, a pressure responsive absorber valve 104 is mounted in the piston 37 and is constructed so as to open under a predetermined pressure and permit flow from the chamber 38 to the portion of the chamber 39 above the floating piston 102. This flow occurs when an underwater obstacle is struck. A let down valve 105 of the check valve type permits flow from the area between the floating piston 102 and the piston 37 back to the chamber 38 when the underwater obstacle is cleared but precludes flow in the opposite direction.

Figure 12:
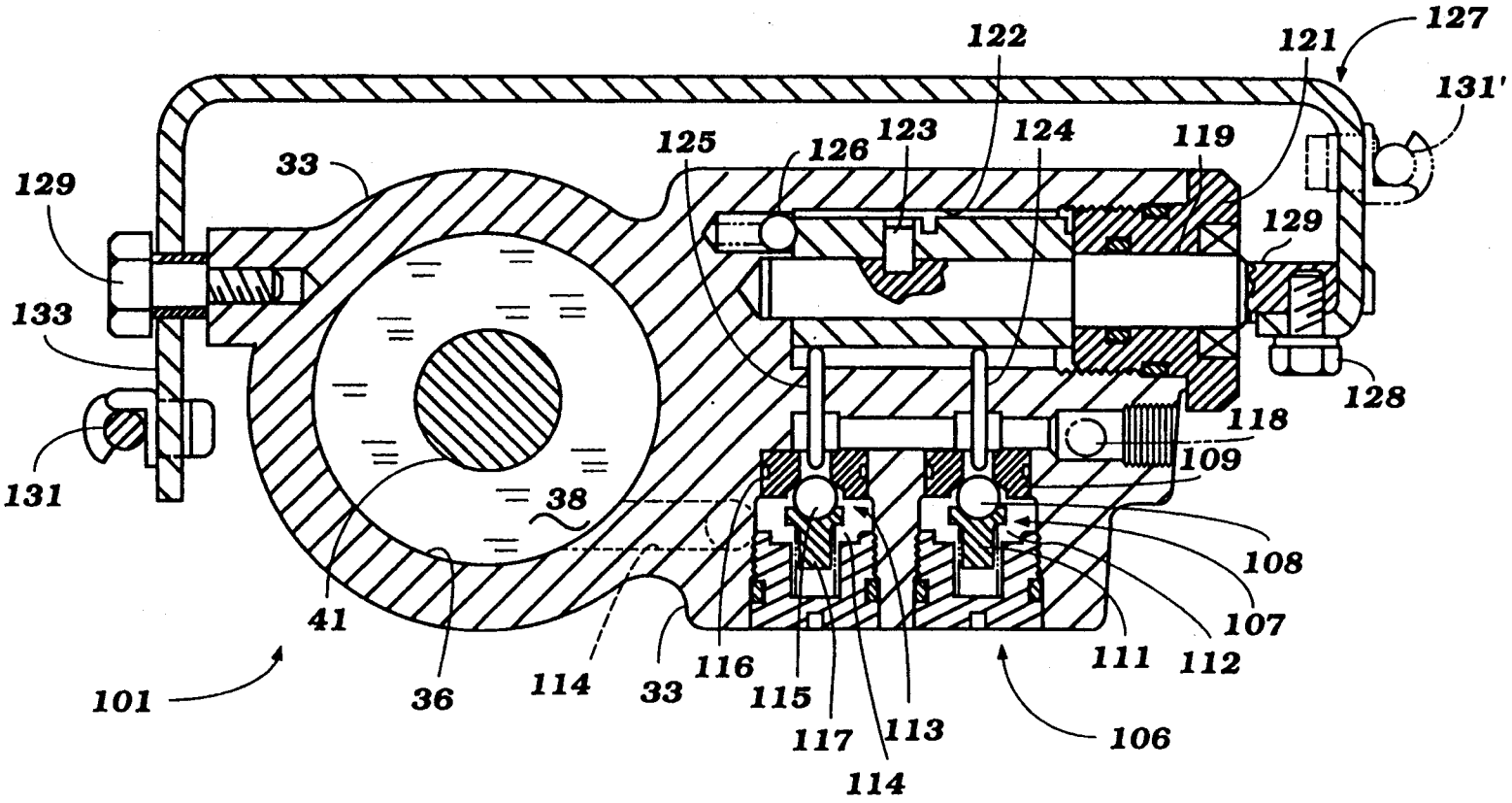
FIG. 12 is a cross sectional view taken along the line 12—12 of FIG. 11.
Figure 13:
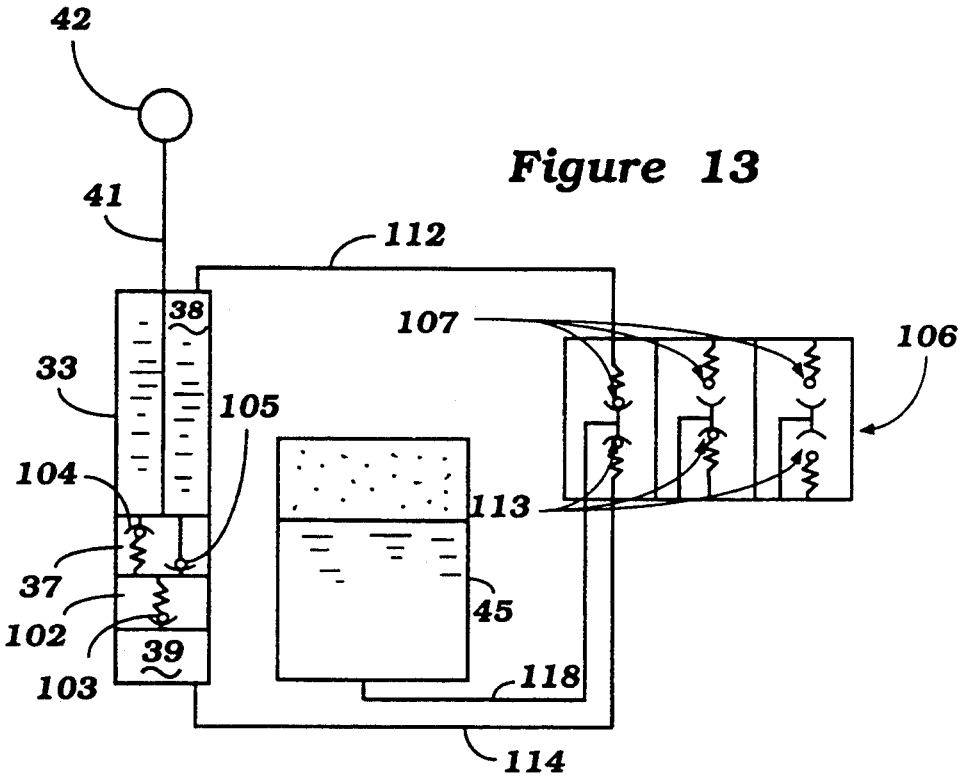
FIGS. 13 and 14 are schematic views showing the hydraulic circuitry in accordance with this embodiment, first in a normal trim controlled position and second in a position wherein the unit may be manually trimmed up.
Figure 14:
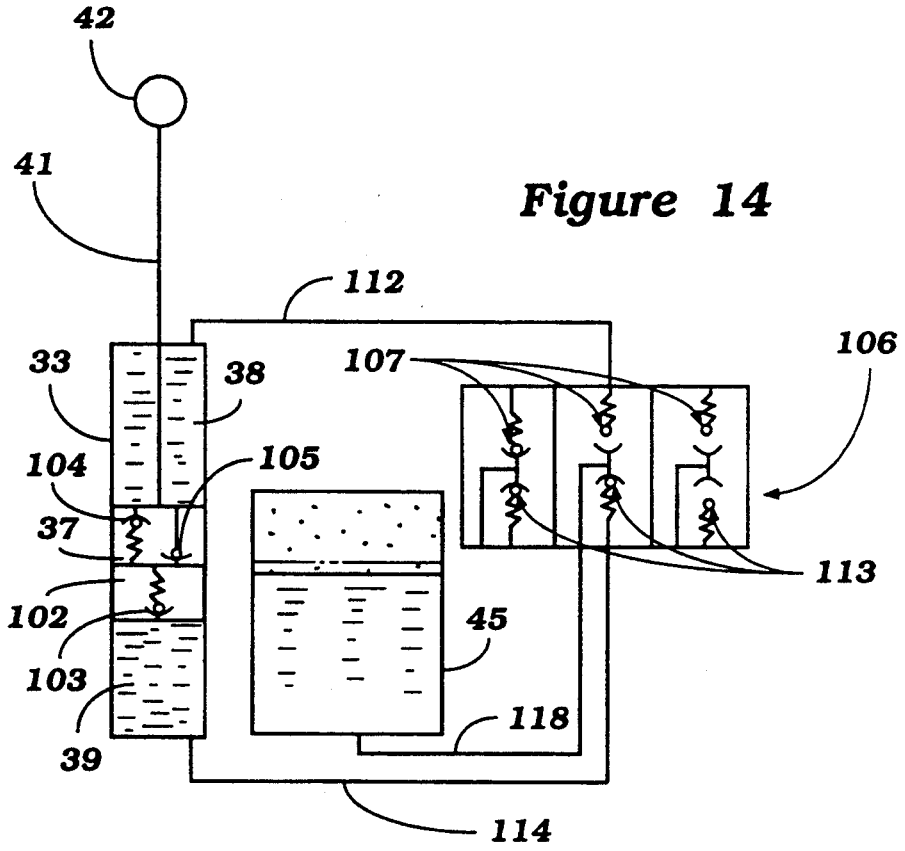

In this embodiment, there is provided a control valve assembly, indicated generally by the reference numeral 106 which control valve assembly is shown best in FIG. 12 but is also shown schematically in FIGS. 13 and 14. This control valve assembly includes a pressure responsive valve 107 that permits flow from the accumulator chamber 45 to the chamber 39 but precludes flow in the opposite direction. As may be seen in FIG. 12, this valve 107 includes a ball type valve 108 that cooperates with a valve seat 109 and is biased into engagement with that seat by a spring assembly 111. A conduit 112 extends from the chamber 38 to the valve 107 so as to apply the pressure from the chamber 38 against the ball valve 108.

A further pressure responsive valve, indicated generally by the reference numeral 113 is provided for controlling the flow between the accumulator chamber 45 and a conduit 114. Like the valve 107, the valve 113 includes a ball type valve element 115 that cooperates with a valve seat 116 and which is biased by a biasing spring assembly 117 to its closed position. The valves 107 and 113 communicate with a conduit 118 that extends to the accumulator chamber 45 and which is positioned between the valves 107 and 113 as shown in schematic FIGS. 13 and 14.

As with the previously described embodiment, the valve assembly 106 is operable to be in a normal position wherein the relief valves 107 and 113 operate only under pressure (FIG. 13) or to a first position for manual trim up wherein the relief valve 107 is manually opened while the relief valve 113 is left in its normal position (FIG. 14) or in a manual trim or tilt down position wherein both of the relief valves 107 and 113 are held open.

To accomplish this motion, there is provided a valve control shaft 119 (FIGS. 11 and 12) that is rotatably journalled in the cylinder assembly 33 by means including a sealing gland 121. A cam 122 is affixed by means of a pin 123 for rotation with the valve controlling shaft 119. This cam 122 has a pair of lobes which engage first and second valve actuating pins 124 and 125 respectively. The valve actuating pin 124 is adapted to engage the ball 108 of the valve 107 and unseat it as shown in FIG. 14. Upon further rotation of the valve controlling shaft 124, the cam associated with the pin 125 will actuate it and unseat the ball 115 and hence manually open the relief valve 113, which position is shown at the extreme right hand side of FIGS. 13 and 14. A ball detent mechanism 126 is associated with the cam 122 for releasably retaining it in each of these three positions.

Figure 10:
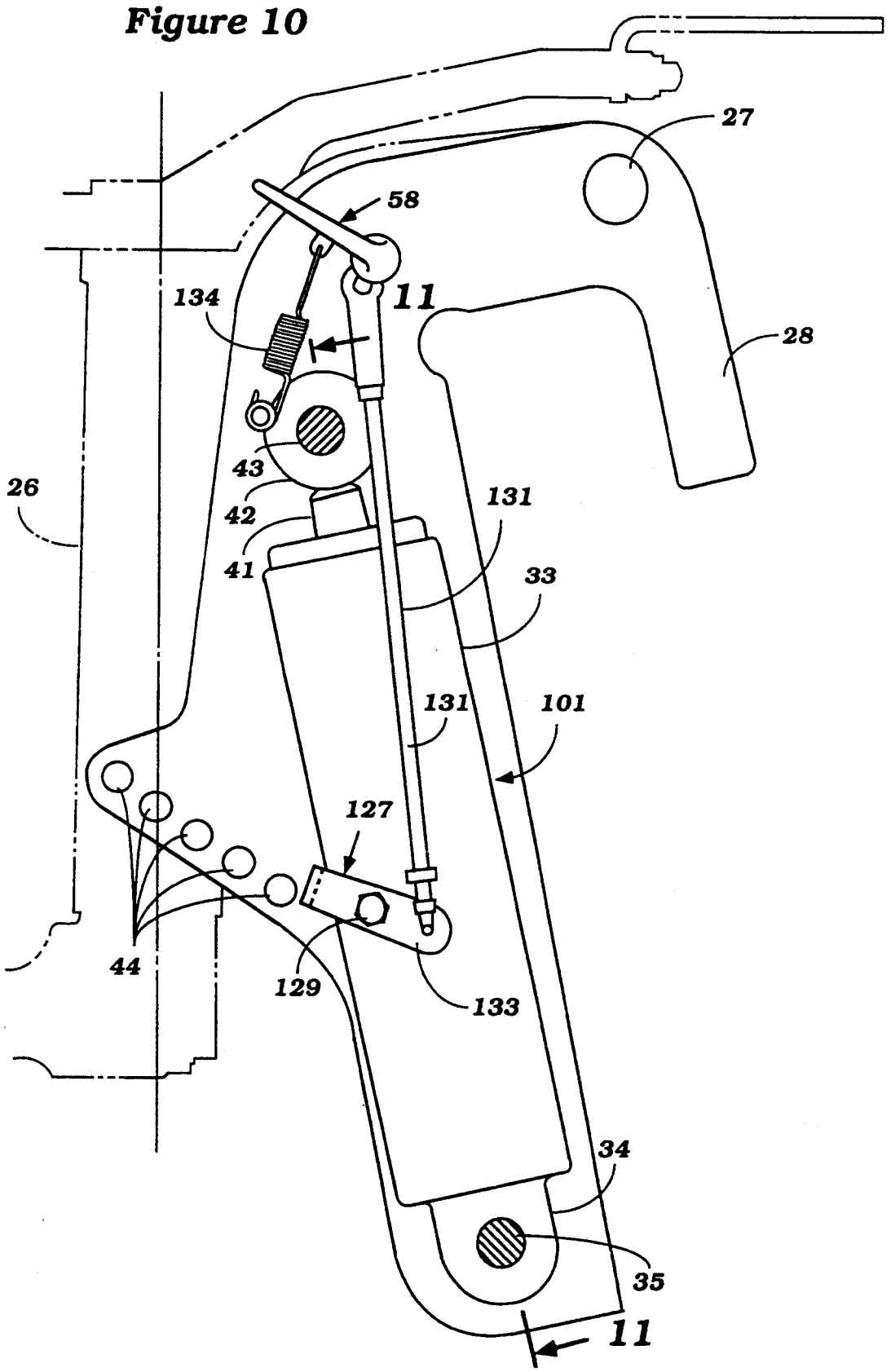
FIG. 10 is a further enlarged side elevational view, in part similar to FIG. 2, and shows another embodiment of the invention and a control operator therefore.
Figure 11:
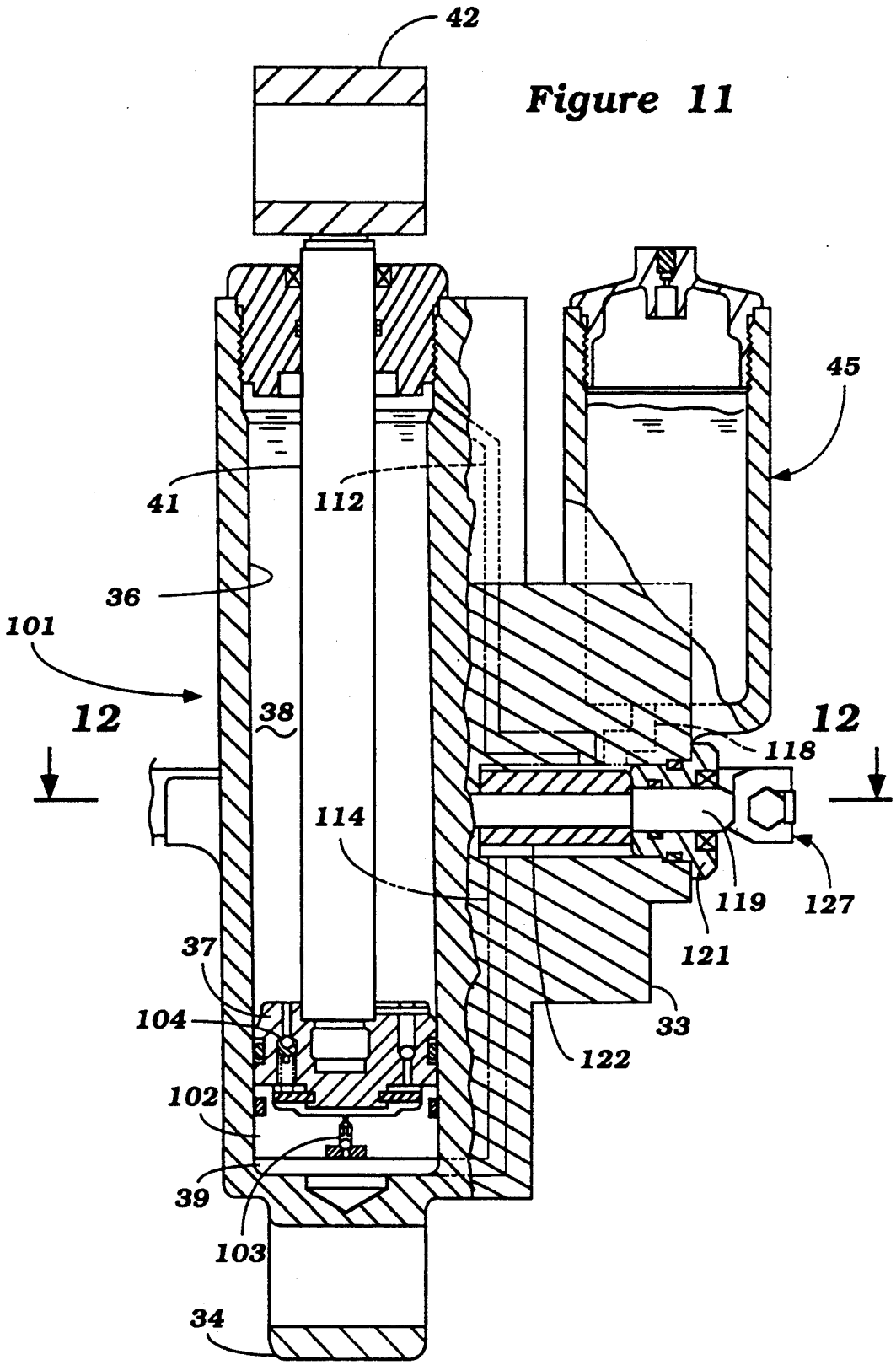
FIG. 11 is a cross sectional view taken along the line 11—11 of FIG. 10.

Normally the valve actuating shaft 119 is accessible and operable only from one side of the cylinder assembly 102 and this is not always desirable. In accordance with another feature of the invention, a mechanism is provided whereby the valve actuating shaft 129 may be operated from either side of the assembly 101 and one such embodiment is shown in FIGS. 10 through 14. This construction includes a generally "C" or "U" shaped actuating element 127 that has one of its short legs connected by a fastener 128 to a protruding end 129 of the valve actuating shaft 119. A long leg of the member 127 spans the assembly 101 and the other short leg is pivotally connected to the opposite side of the cylinder assembly 33 by means of a pivot bolt 129. Hence, an actuating rod 131 may be connected to one side of the actuator leg 133 as shown in FIG. 10 and FIG. 12 on one side of the mechanism. This mechanism is operated by the control lever 58 previously referred to in conjunction with the embodiments of FIGS. 1 through 9. A tension spring 134 may be connected between to the lever 58 so as to normally urge it to the normal position as shown in FIG. 13 wherein the relief valves 107 and 113 are both in their normal operating positions.

As may be seen in FIG. 12, an alternative control rod connection 131 may be provided to the end of the actuating member 127 directly adjacent the valve actuating shaft 119.

Figure 15:
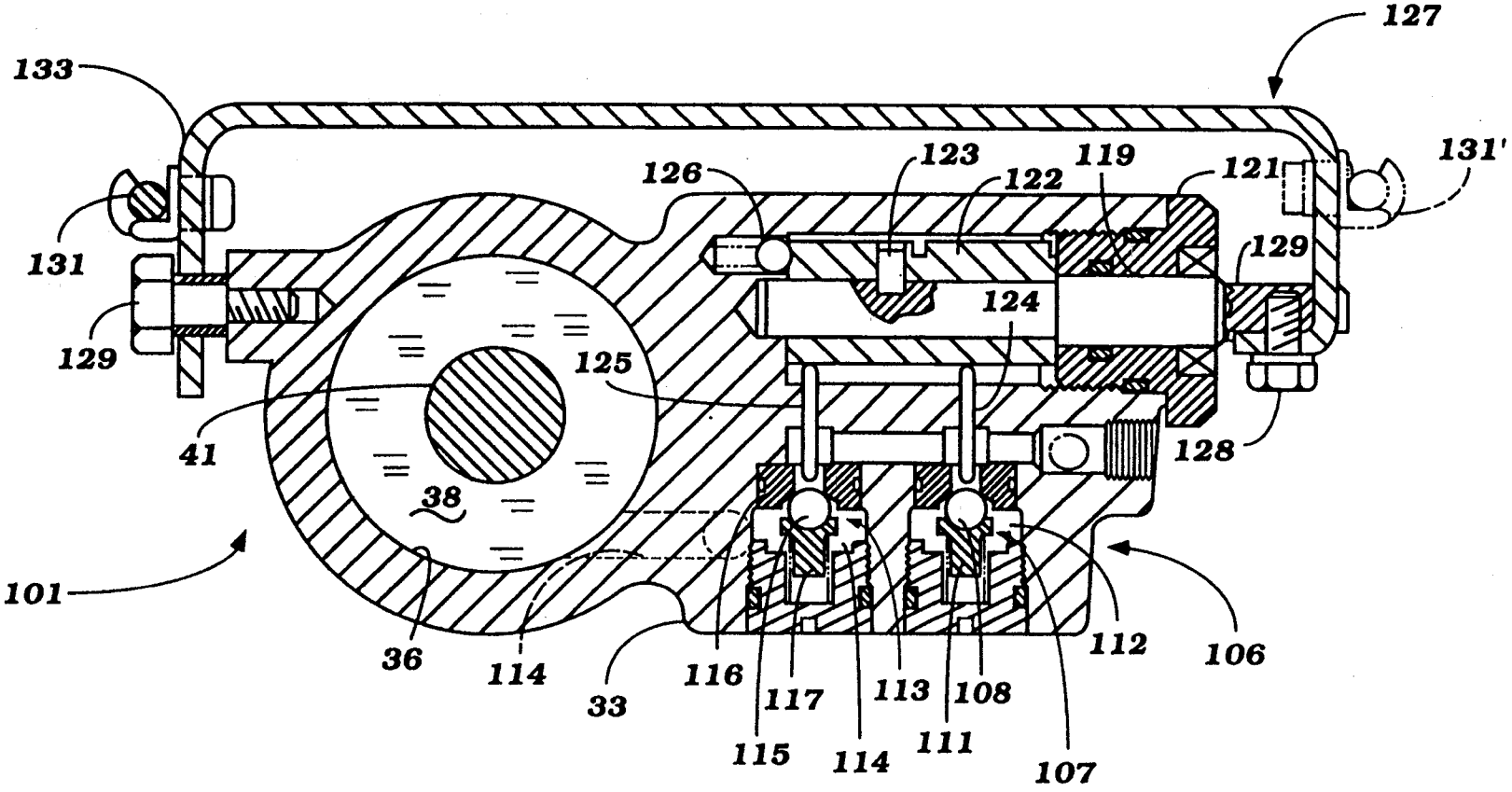
FIG. 15 is a cross sectional view, in part similar to FIG. 12, and shows a third embodiment.

FIG. 15 shows an embodiment wherein both legs of the valve actuating member 127 have the same length but is otherwise the same as the embodiment of FIGS. 10 through 14.

The operation of the embodiments of FIGS. 10 through 14 and 15, will now be described by reference to FIGS. 13 and 14. FIG. 13 shows the valve 106 in its normal position corresponding to the position shown in FIGS. 12 and 13 wherein each of the relief valves 107 and 113 will operate normally. Assuming an underwater obstacle is struck, a force will be exerted on the piston rod 41 tending to move it upwardly. If this force is sufficient so as to overcome the pressure at which the absorber valve 104 will open, then the piston 37 can move upwardly with fluid being displaced from the chamber 38 through the valve 104 to the portion of the chamber 39 above the floating piston 102. As has been previously noted, the amount of fluid displaced from the chamber 38 will be less than the amount of fluid transferred to the chamber 39 above the floating piston 102 because of the displacement of the piston rod 41. If any make-up fluid is required, it can be delivered to the chamber 39 from the accumulator 45 by opening of the pressure responsive valve 113.

Once the underwater obstacle is cleared, the let down valve 105 will open under the weight of the outboard motor acting on the piston 37 through the piston rod 41 and the piston 37 will move to its previous position.

If it is desired to provide manual tilt or trim up adjustment, the lever 58 is moved so as to rotate the actuating member 127 and control valve shaft 119 to rotate the cam 122 sufficiently so as to actuate the pin 124 and unseat the relief valve 107 as shown in FIG. 14. When this occurs, and a lifting force is exerted on the outboard motor 21 fluid may easily be displaced from the chamber 38 through the conduit 112 and open relief valve 107 to the conduit 118. More fluid is required for the chamber 39 again due to the displacement of the piston rod 41 and this fluid may be supplied from the accumulator chamber 45 through opening of the pressure responsive valve 113 without any fluid restriction. Hence, the outboard motor may easily be trimmed up to any desired trim or tilted up position.

If it is desired to trim or tilt down the outboard motor, the lever 58 is actuated to further rotate the cam 122 to actuate the pin 125 and unseat the ball valve 115 of the valve assembly 113. This is the extreme right hand position of the control valve 106 as shown in FIGS. 13 and 14, as aforenoted. When this occurs, the downward force on the piston rod 41 will cause the piston 37 to be forced downwardly and also to force the floating piston 102 downwardly to displace fluid from the chamber 39 back to the accumulator chamber 45 through the open valve 113 and passage 118. The valve 103 in the floating piston 102 will open at this time. At the same time, fluid may flow from the chamber 39 directly to the chamber 38 through the open valve 107 passing via the conduit 112. Actually more fluid will be displaced from the chamber 39 then required to the chamber 38 again due to the displacement of the piston rod 41 and hence some fluid will be returned to the accumulator chamber 45.

It should be readily apparent from the foregoing description that the described embodiments of the invention permit ease of operation of the control valve assembly from either side of the unit. In addition, the embodiment of FIGS. 1 through 9 permits normal tilt and trim operation and obviates the need for a floating piston.

It is to be understood that the foregoing description of preferred embodiments of the invention and various changes and modifications may be made without departing from the spirit and scope of the invention, as defined by the appended claims.

It is claimed:

1. A hydraulic assembly for controlling the position of an outboard drive mounted to the transom of a watercraft between a normal drive position and a popped up position when an underwater obstacle is struck and returned to the normal position when the underwater obstacle is cleared, said assembly comprising a cylinder adapted to be connected to one of said outboard drive and said watercraft, a piston having a piston rod connected to the other of said outboard drive and said watercraft, saidpiston being slideably received in said cylinder and dividing said cylinder into two chambers with said piston rod extending through one of said chambers, an accumulator chamber for containing fluid and gas under pressure to accommodate changes in volume caused by the passage of said piston rod through said one chamber upon relative movement between said outboard drive and said watercraft, first conduit means containing first check valve means for permitting flow from said one cylinder chamber to said accumulator chamber only, second conduit means containing second check valve means for permitting flow from the other of said cylinder chambers to said accumulator chamber only, a pressure relief valve for permitting flow from one of said cylinder chambers only to said accumulator chamber when the pressure difference is greater than a predetermined amount, and a third check valve for permitting flow only from said accumulator chamber to the other of said cylinder chambers.

2. A hydraulic assembly as set forth in claim 1 wherein the first and second conduit means have a common portion.

3. A hydraulic assembly as set forth in claim 2 wherein the pressure relief valve is positioned in the common portion of the first and second conduit means.

4. A hydraulic assembly as set forth in claim 1 further including manually operated means for opening one of said check valves.

5. A hydraulic assembly as set forth in claim 1 further including manually operated means for opening the relief valve.

6. A hydraulic assembly as set forth in claim 5 wherein the manually operated means further is effective to open one of the check valves.

7. A hydraulic assembly as set forth in claim 6 wherein the manually operated means sequentially opens first one of the check valves and then the release valve.

8. A hydraulic assembly as set forth in claim 7 wherein the manually operated means is accessible from either side of the hydraulic assembly.

9. A hydraulic assembly as set forth in claim 4 wherein the manually operated means is accessible from either side of the hydraulic assembly.

10. A hydraulic assembly as set forth in claim 5 further including manually operated valves for releasing one of said check valves.

11. A hydraulic assembly as set forth in claim 8 wherein the manually operated means includes a valve actuating shaft rotatably journalled in the cylinder and a generally U-shaped actuator cylinder and having short legs pivotally mounted on opposite sides of the cylinder and connected to the valve shaft.

12. A hydraulic assembly for controlling the position of an outboard drive mounted to the transom of a watercraft between a normal drive position and a popped up position when an underwater obstacle is struck and returned to the normal drive position when the underwater obstacle is cleared, said assembly comprising a cylinder adapted to be connected to one of said outboard drive and said watercraft, a piston having a piston rod connected to the other of said outboard drive and said watercraft, said piston being slidably received in said cylinder and dividing said cylinder into two chambers with said piston rod extending through one of said chambers, conduit means including valve means for permitting flow between same chambers for resisting popping up of the outboard drive relative to the watercraft until a predetermined force is encountered, manually operable means having portions disposed on opposite sides of said hydraulic assembly for opening said valve means from either side of said hydraulic assembly for permitting movement of said outboard drive without hydraulic restriction upon the application of a force thereto.

13. A hydraulic assembly as set forth in claim 12 wherein the manually operable means includes a valve actuating shaft rotatably journalled in the cylinder and a generally U-shaped actuator with short legs pivotally mounted on opposite sides of the cylinder and connected to the valve shaft and forming the portions for opening the valve means from either side of the hydraulic assembly.

* * * * *